US006835056B2

(12) United States Patent
van der Sluis et al.

(10) Patent No.: US 6,835,056 B2
(45) Date of Patent: Dec. 28, 2004

(54) ROLLER VANE PUMP INCORPORATING A BEARING BUSH

(75) Inventors: Francis Maria Antonius van der Sluis, Sint Michielstestel (NL); Johannes Gerardus Ludovicus Maria van Spijk, Drunen (NL)

(73) Assignee: Van Doorne's Transmissie B.V., Tilburg (NL)

( * ) Notice: Subject to any disclaimer, the term of this patent is extended or adjusted under 35 U.S.C. 154(b) by 0 days.

(21) Appl. No.: 10/362,866

(22) PCT Filed: Aug. 20, 2001

(86) PCT No.: PCT/EP01/09654

§ 371 (c)(1),
(2), (4) Date: Jul. 7, 2003

(87) PCT Pub. No.: WO02/16771

PCT Pub. Date: Feb. 28, 2002

(65) Prior Publication Data

US 2004/0037728 A1 Feb. 26, 2004

(30) Foreign Application Priority Data

Aug. 25, 2000 (EP) ..... 00202956

(51) Int. Cl.[7] ..... F04C 2/344; F16C 33/10

(52) U.S. Cl. ..... 418/225; 418/102; 418/179; 384/291

(58) Field of Search ..... 418/88, 102, 179, 418/225; 417/204; 384/291, 292

(56) References Cited

U.S. PATENT DOCUMENTS

| | | | | |
|---|---|---|---|---|
| 3,025,802 A | | 3/1962 | Browne | |
| 3,404,634 A | * | 10/1968 | Connelly | 418/225 |
| 4,056,337 A | | 11/1977 | Zorn et al. | |
| 5,472,328 A | | 12/1995 | Saito et al. | |
| 5,667,372 A | | 9/1997 | Hwang et al. | |
| 6,109,900 A | | 8/2000 | Ishizuka et al. | |
| 6,241,394 B1 | * | 6/2001 | Kallenberger et al. | 384/291 |

FOREIGN PATENT DOCUMENTS

| | | | | |
|---|---|---|---|---|
| DE | 198 27 932 A1 | | 6/1998 | |
| EP | 0 679 809 A2 | | 11/1995 | |
| EP | 1 020 642 A1 | | 7/2000 | |
| JP | 3-233188 | * | 10/1991 | 418/179 |

* cited by examiner

*Primary Examiner*—John J. Vrablik
(74) *Attorney, Agent, or Firm*—Troutman Sanders LLP; Ryan A. Schneider

(57) ABSTRACT

Roller vane pump, in particular suited for pumping fluid in a continuously variable automatic transmission of a motor vehicle, provided with a pump housing accommodating a substantially cylindrical carrier, which is rotatable about a central axis, and a cam ring encompassing the carrier in the radial direction, whereby a radial clearance between the carrier and the cam ring varies along a circumference of the carrier, and with a pump shaft extending co-axial with said central axis through the carrier, characterised in that there is provided in the pump housing a bearing bush having an essentially cylindrical central bore through which the pump shaft extends.

17 Claims, 5 Drawing Sheets

Prior Art

Prior Art

ROLLER VANE PUMP INCORPORATING A BEARING BUSH

BACKGROUND OF THE INVENTION

The invention relates to a roller vane pump and in particular to a roller vane pump suited for pumping fluid in a continuously variable automatic transmission (CVT) for motor vehicles. Such a roller vane pump is known from the European patent 0.921.314 and is intended for pumping automatic transmission fluid in hydraulically controlled and/or operated continuously variable transmissions for motor vehicles. Particularly in a belt-and-pulley type CVT, a large flow of fluid at a high pressure may be required for control of the transmission. The known pump may be provided with several pump units, whereby a pump unit is a functional pump unit, i.e. having a suction section where fluid is drawn into the pump and a discharge section where fluid is discharged from the pump. Since the pump is usually driven by a main drive shaft of the vehicle, it is designed to be able to provide a desired pump yield, i.e. a desired flow of fluid, even at a lower most rotational speed of the drive shaft, e.g. idle speed. At the same time, the pump is designed to reliably withstand prolonged operation at an upper most rotational speed of the drive shaft.

The known pump is provided with a pump housing accommodating a substantially cylindrical carrier, which is rotatable about a central axis, and with a cam ring encompassing the carrier in the direction, whereby a clearance in the radial direction between the carrier and the cam ring varies along a circumference of the cam ring. The carrier is provided with a number of slots extending inwardly from the radially outer surface of the carrier, at least some of which slideably accommodate a roller element. The carrier is rotatable by means of a pump shaft extending co-axial with said central axis through the carrier. The pump shaft is supported in the housing on axial sides of the carrier, whereby the housing provides a bearing surface for the pump shaft. A small gap exists between the carrier and the pump housing as a result of an axial clearance introduced there between, which gap allows the carrier to rotate with respect to the housing. The gap further enables a lubrication flow from the discharge section of a pump unit to the bearing surface for lubrication thereof. It is noted that, as a consequence, the gap also enables a leakage flow from the high-pressure discharge section to the low-pressure suction section, which affects pump efficiency. Usually, said axial clearance will, therefore, be set as little as possible given a desired amount of lubrication.

The known pump has the disadvantage that the carrier may slightly tilt with respect to the pump housing under the influence of for instance mechanical shocks, changes in the rotational speed or changes in the fluid pressure at the discharge section. Particularly, when the pump shaft is relatively long a substantial movement of the carrier may occur. A rotation of the carrier causes said gap to vary along its circumference. At a location where said clearance is large, said leakage flow will also be large, whereby the -volumetric- pump efficiency is disadvantageously affected, whereas at a location where said clearance is small, possibly even non-existent, friction between the carrier and the housing is high, whereby the -mechanical- pump efficiency is again disadvantageously affected. At a location where said gap is non-existent, wear of the pump housing and of the carrier may also become a problem.

The above mentioned disadvantage of the known pump is particularly relevant when the pump housing is made of a light weight and/or soft material, such as aluminium, which is generally also a ductile material and/or when the carrier is rigidly fixed to the pump shaft. In such cases, said movement of the carrier may occur with relative ease, causing the width of said gap to change considerably along the circumference of the carrier. It is an object of the present invention to improve the pump efficiency of the known roller vane pump.

SUMMARY OF THE INVENTION

According to the invention this object is achieved with the roller vane pump, wherein there is provided in the pump housing a bearing bush having an essentially cylindrical central bore through which the pump shaft extends. In the pump according to the invention there is provided a separate bearing bush, which bearing bush accommodates the pump shaft in the pump housing and provides a bearing surface for the rotation of the said shaft. The provision of the bearing bush stiffens the construction of the pump shaft and thereby reduces said movement of the pump shaft.

In a further development of the invention, the bearing bush is made of material a less ductile than aluminium, such as copper. It is further preferred that the bearing bush tightly fits around said pump shaft in the radial direction. Both features have the advantage that the freedom of movement of the pump shaft is restricted. It may also be advantageous to provide a bearing bush on either axial end of the carrier. In this manner a stable configuration of the pump housing, the pump shaft and the carrier is achieved.

According to the invention it is advantageous, if the bearing bush is provided with a lubrication groove on a radially inner surface thereof, preferably having a substantially elongated shape with a long axis, for allowing a fluid to penetrate between the bearing bush and the pump shaft. To this end the lubrication groove may start at an axial end of the bearing bush closest to the carrier and continues with its long axis oriented in a direction having an axial component. The lubrication groove allows a flow of lubrication fluid in between the pump shaft and the bearing bush, even if the bearing bush fits relatively tightly around said shaft. The lubrication groove may span the entire axial length of the bearing bush. However, to prevent substantial fluid communication with the environment, it is preferred that the lubrication groove ends at some distance from the axial end of the bearing bush opposite said axial end of the bearing bush closest to the carrier. When the lubrication groove is oriented at an angle with respect to the axial direction, the lubrication fluid is distributed over at least a part of a circumference of the pump shaft. For optimum distribution of the lubrication fluid, the said angle is set such that the lubrication groove extends in the direction of rotation of the pump shaft.

As mentioned in the above, the pump is provided with one or more low pressure suction sections and one or more high pressure discharge sections, which sections are located alternately along the circumference of the cam ring. When said pressures are unevenly distributed along said circumference, a net-force acts on the carrier and on the pump shaft at a specific tangential location, which net-force urges the pump shaft in a generally radial direction. Thus, when the pump is provided with a single pump unit, or when the pump units have mutually different discharge pressures, a contact pressure between the pump shaft and the bearing bush is unevenly distributed in dependence on tangential position and varies between a highest level, at a tangential position substantially opposite a tangential position of the discharge section having the highest discharge pressure, and a lowest level, at a tangential position substantially corresponding to the tangential position of the discharge section having the highest discharge pressure. According to the invention, it is in such cases to be preferred that the lubrication groove is predominantly located in a region of tangential positions where the said contact pressure is relatively low, so that there is no need to disturb the contact between the pump shaft and the bearing bush at the location where the said contact pressure is the highest.

In a further elaboration of such embodiment, the lubrication groove starts at a tangential position of the discharge section where the prevailing pressure is at a maximum, whereby a tangential position corresponding to a central part of the said section is particularly suitable. If in such a case the long axis of the lubrication groove is oriented at an angle with respect to the axial direction, it is preferable that either one or both of a length of the lubrication groove and of said angle are chosen such that it extends in the tangential direction over an angle which approximately corresponds to $\pi$ minus $\frac{1}{2}\pi$ divided the number of pump units of the pump. This measure effects that the lubrication groove does not extend into the region of tangential positions where the said contact pressure is the highest.

In yet a further development of the pump according to the invention, the bearing bush is provided with a distribution groove on its inner surface having a substantially elongated shape with a long axis that is oriented substantially axially and that intersects the long axis of the lubrication groove, for further improving the distribution of the lubrication fluid. The distribution groove may extend over a substantial part of an axial dimension of the bearing bush. It is, however, to be preferred if there remains a distance of at least ¼ of the said axial dimension between an axial end of the bearing bush and of the distribution groove so as to limit communication of lubrication fluid between the distribution groove and the environment.

The invention will now be explained in greater detail with reference to the non-restricting examples of embodiment shown in the drawings.

DESCRIPTION OF THE PREFERRED EMBODIMENT

Figure 1:
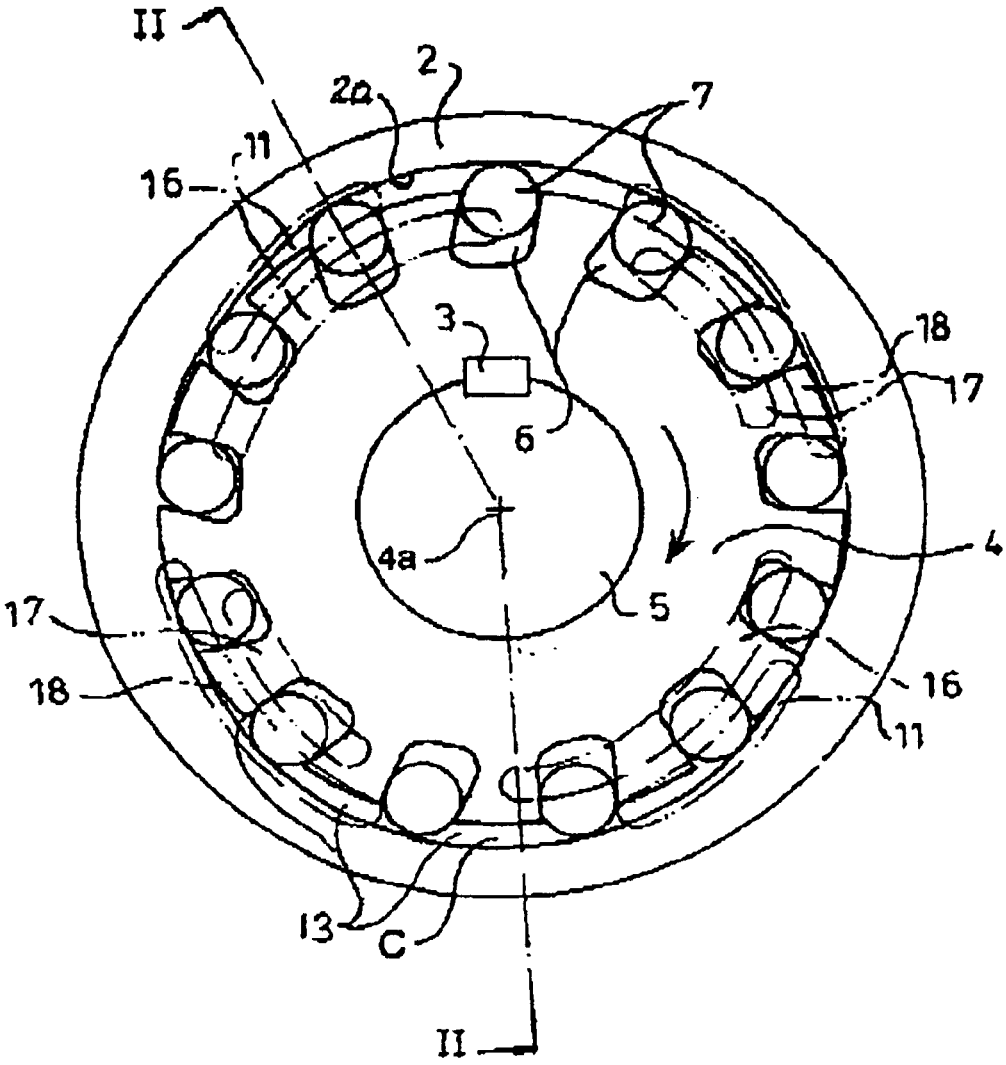
FIG. 1 is an axial cross section of the known roller vane known pump taken at an axial position immediately adjacent to the carrier.
Figure 2:
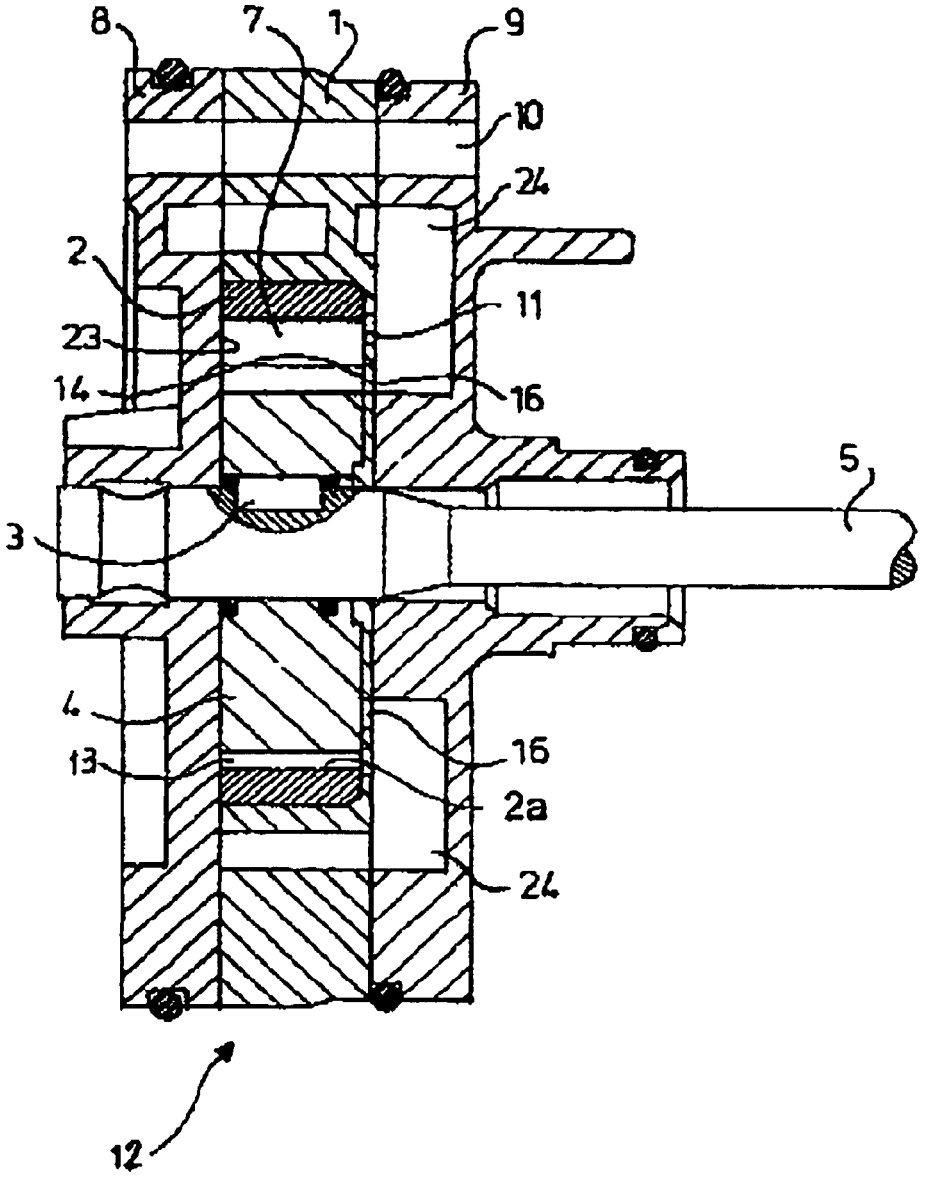
FIG. 2 is a tangential cross section of the known pump.

FIGS. 1 and 2 respectively provide an axial cross section and a tangential cross section of the known roller vane pump. The known pump comprises a pump housing 12 that is composed of three pump housing parts 1, 8 and 9, which can be secured to each other by means of bolts (e.g. bolt 25 shown in FIG. 3) that are inserted in holes in the pump housing 12, e.g. hole 10. The central pump housing part 1 accommodates an essentially cylindrically shaped carrier 4, which is rotatable about a central axis 4*a* in a direction of rotation indicated by the arrow by means of a pump shaft 5, and a cam ring 2 with a radially inward oriented cam surface 2*a*, which cam ring 2 radially encompasses the carrier 4, whereby a clearance C in the radial direction between the carrier 4 and the cam ring 2 varies along the circumference of the cam ring 2. On its periphery the carrier 4 is provided with radially inwardly extending slots 6 that accommodate essentially cylindrically shaped roller elements 7. The roller elements 7 are accommodated in the slots 6, such that they are able to slide in a predominantly radially oriented direction. The pump shaft 5 extends in axial direction through the carrier 4 and, on either axial side thereof, is supported in the pump housing 12, whereby the housing 12 provides a bearing surface. The pump shaft 5 is fixed to the carrier 4 by means of a wedge 3.

During operation of the pump, the carrier 4, the cam ring 2, and the roller elements 7 define a number of pump chambers 13 that are bound in axial sense by the inner surfaces 23 and 14 of the outer pump housing parts 8 and 9 respectively and that may arrive in communication with a supply line 24 in the pump housing 12 for hydraulic fluid, through one or more of a number of supply ports 11 and 16 and which may arrive in communication with a discharge line (not shown) in the pump housing 12 for hydraulic fluid, through one or more of a number of discharge ports 17 and 18. When the carrier 4 is rotated during operation of the pump, a surface area of the pump chambers 13 as seen in axial cyclically increase and decrease, as can be deduced from in FIG. 1. Accordingly, a volume of the pump chambers 13 also cyclically increase and decrease, so that, on the one hand, fluid sucked from the supply line into the pump chamber 13 when its volume increases, i.e. at the location of a so-called low pressure pump section L, and, on the other hand, fluid is pressed out of the pump chamber 13 when its volume decreases, i.e. at the location of a so-called high pressure pump section H.

Figure 3:
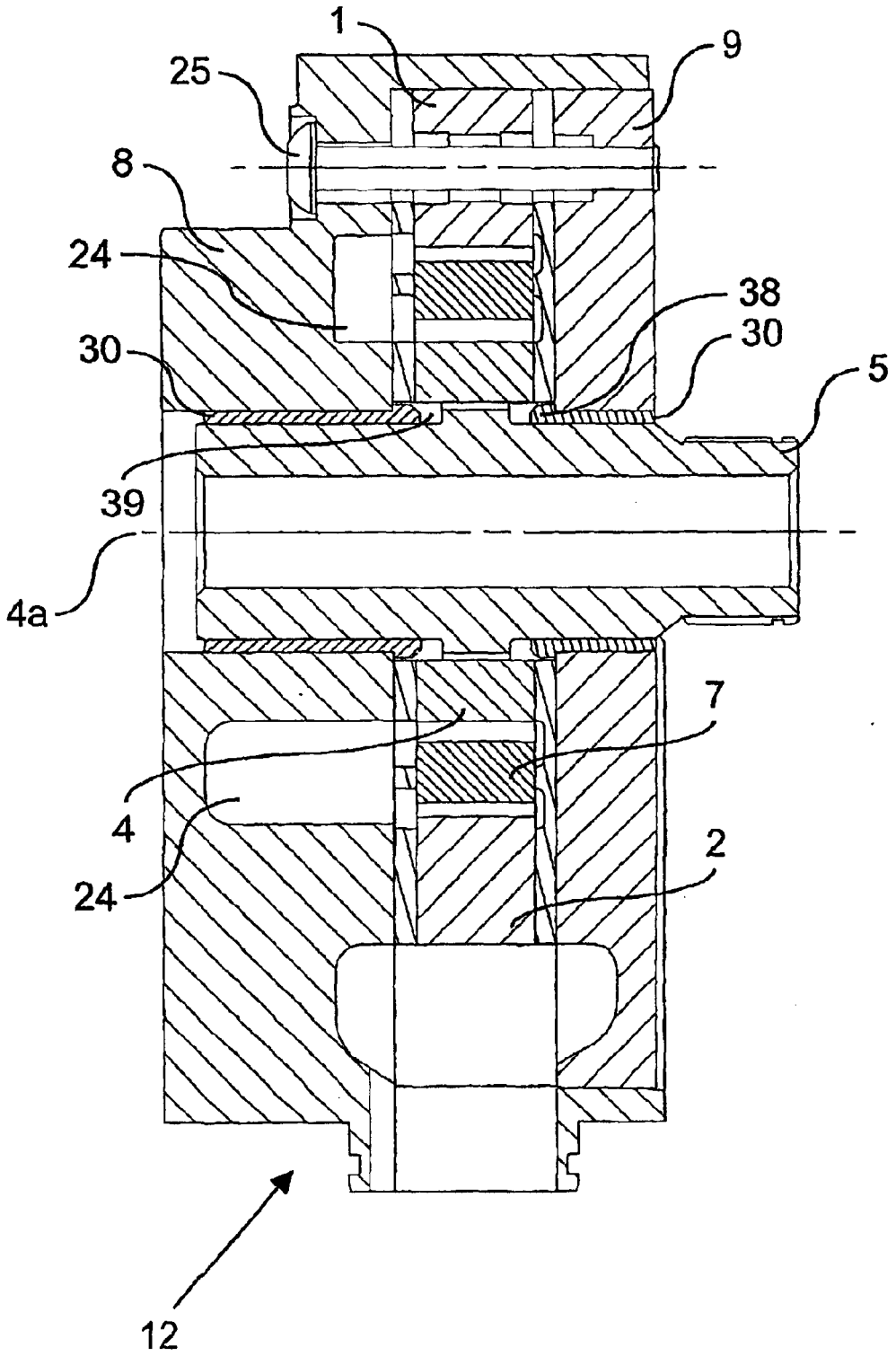
FIG. 3 is a tangential cross section of a roller vane pump according to the invention.

FIG. 3 is a tangential cross section of an embodiment of the roller vane pump according to the invention. In this figure similar pump parts are provided with the same reference numeral as provided in FIGS. 1 and 2. On either axial side of the carrier 4, there is provided a bearing bush 30 in the pump housing 12 through which the pump shaft 5 extends in the axial direction. The bearing bushes 30 provide a bearing surface for the rotation of the pump shaft 5 and also stiffen the construction of the pump. At an axial end 33 of the bearing bush 30 closest to the carrier 4, the bushes 30 are provided with a hook part 38 that is formed by a radially outwardly oriented thickening that interacts with the pump housing 12 to prevent the bushes 30 from axially moving with respect to the pump housing 12. Lubrication fluid is provided to a gap (not shown) between the radially inner surface of the bushes 30 and the radially outer surface of the pump shaft 5 from an essentially annular cavity 39 within the pump housing 12. Here said cavity 39 is bound by the carrier 4, the pump shaft 5 and the bearing bush 30. In the cavity 39 there exists an elevated fluid pressure as a result of a leakage flow from the pump chambers 13, in particular the chambers 13 at the location of a high pressure pump section H, to the cavity 39. This leakage is enabled by a small gap (not shown) between the housing 12 and the carrier 4, which gap allows the carrier 4 to rotate in the housing 12. The annular cavity 39 advantageously forms a reservoir for lubrication fluid at an elevated pressure, from which cavity 39 the interface between the pump shaft 5 and the bushes 30 is reliably provided with lubrication.

Figure 4:
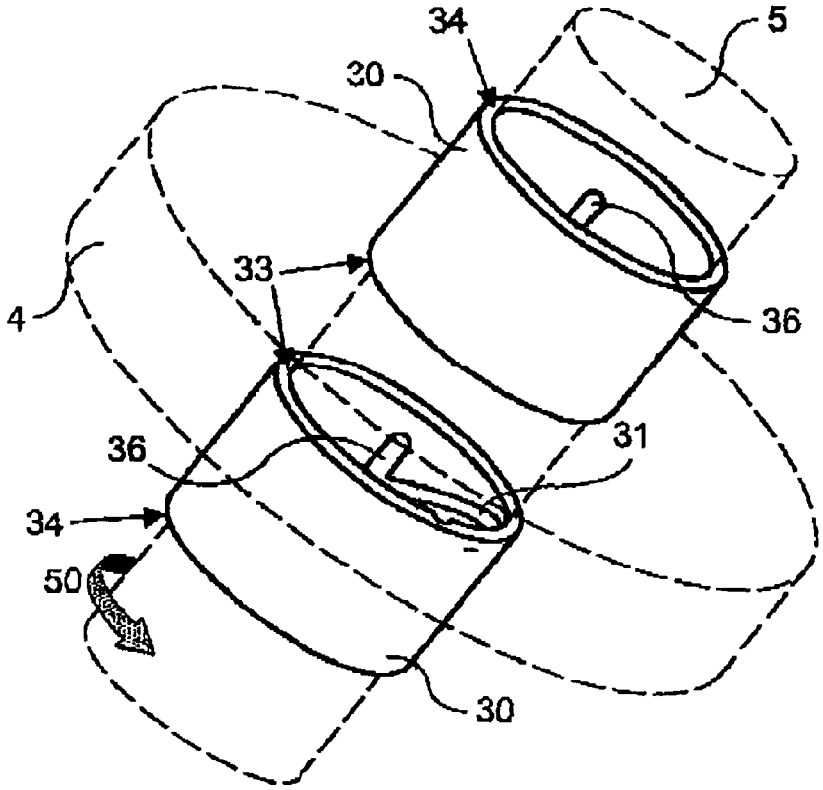
FIG. 4 is a perspective view of a bearing bush for the roller vane pump according to the invention.
Figure 5:
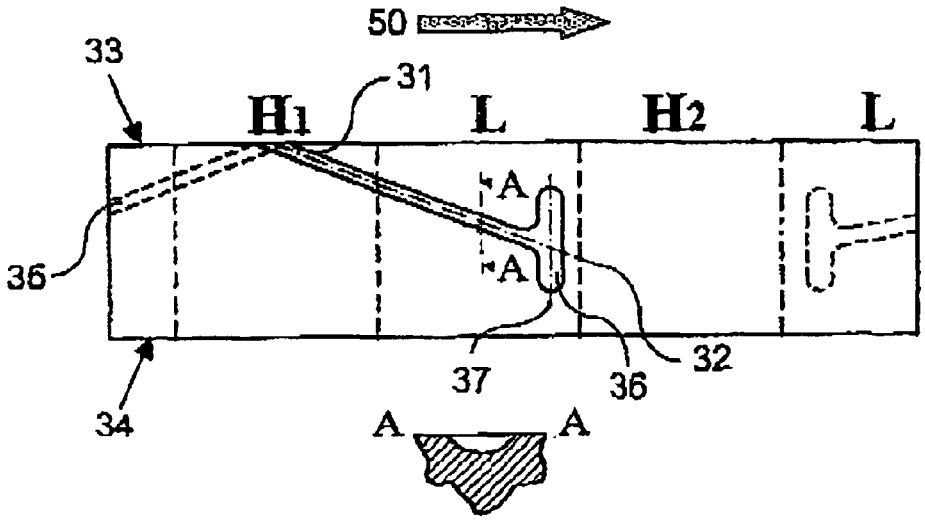
FIG. 5 is a plane view of the inner surface of a bearing bush according to the invention.

FIGS. 4 and 5 are two views of an embodiment of the bearing bush 30, whereby FIG. 4 is a perspective view and FIG. 5 is a plane view of a radially inner surface of the bush 30. In FIG. 4 the dashed lines schematically indicate the outer edges of the corner 4 and the shaft 5. In the embodiment of FIGS. 4 and 5, the bearing bush 30 is provided with a lubrication groove 31 on its radially inner surface having a substantially elongated shape with a long axis 32, whereby the lubrication groove 31 starts at an axial end 33 of the bearing bush 30 closest to the carrier 4 and continues with its long axis 32 oriented at an angle of about 60 degrees with the axial direction, such that it extends in tangential direction in the direction of rotation 50 of the pump shaft. The lubrication groove 31 allows a flow of lubrication fluid in between the pump shaft 5 and the bearing bush, even when the bearing bush 30 fits relatively tightly around said shaft 5. To prevent substantial fluid communication with the environment, the lubrication groove 30 ends at some distance from an axial end 34 of the bearing bush opposite the said axial end 33 of the bearing bush 30 closest to the carrier 4. As indicated in FIG. 5 the bearing bush 30 is oriented such that it starts at a tangential position of a discharge section H1 of the pump where the prevailing pressure is at a maximum and it continues in tangential direction through a suction section L up to the tangential position of a discharge section H2 where the prevailing pressure is smaller than it the first mentioned section H1, so that it extends in tangential direction of an angle of about $\pi$ minus $\frac{1}{2}\pi$ divided by 2, i.e. the number of pump units of the pump of FIG. 3.

According to the invention the bearing bush 30 may be provided with a further lubrication groove 35, as is indicated by the dashed lines in FIG. 5. It is further advantageous to provide the radially inner surface of the bearing bush 30 with a distribution groove 36 having a long axis 37 that is oriented substantially axially and intersecting the long axis 32 of the lubrication groove 31. The distribution groove 36 extends over a distance of at about ½ of an axial dimension of the bush 30, but remains at a distance of about ¼ from either axial end 33, 34 thereof to limit communication of lubrication fluid between the distribution groove 36 and the environment.

Figure 6:
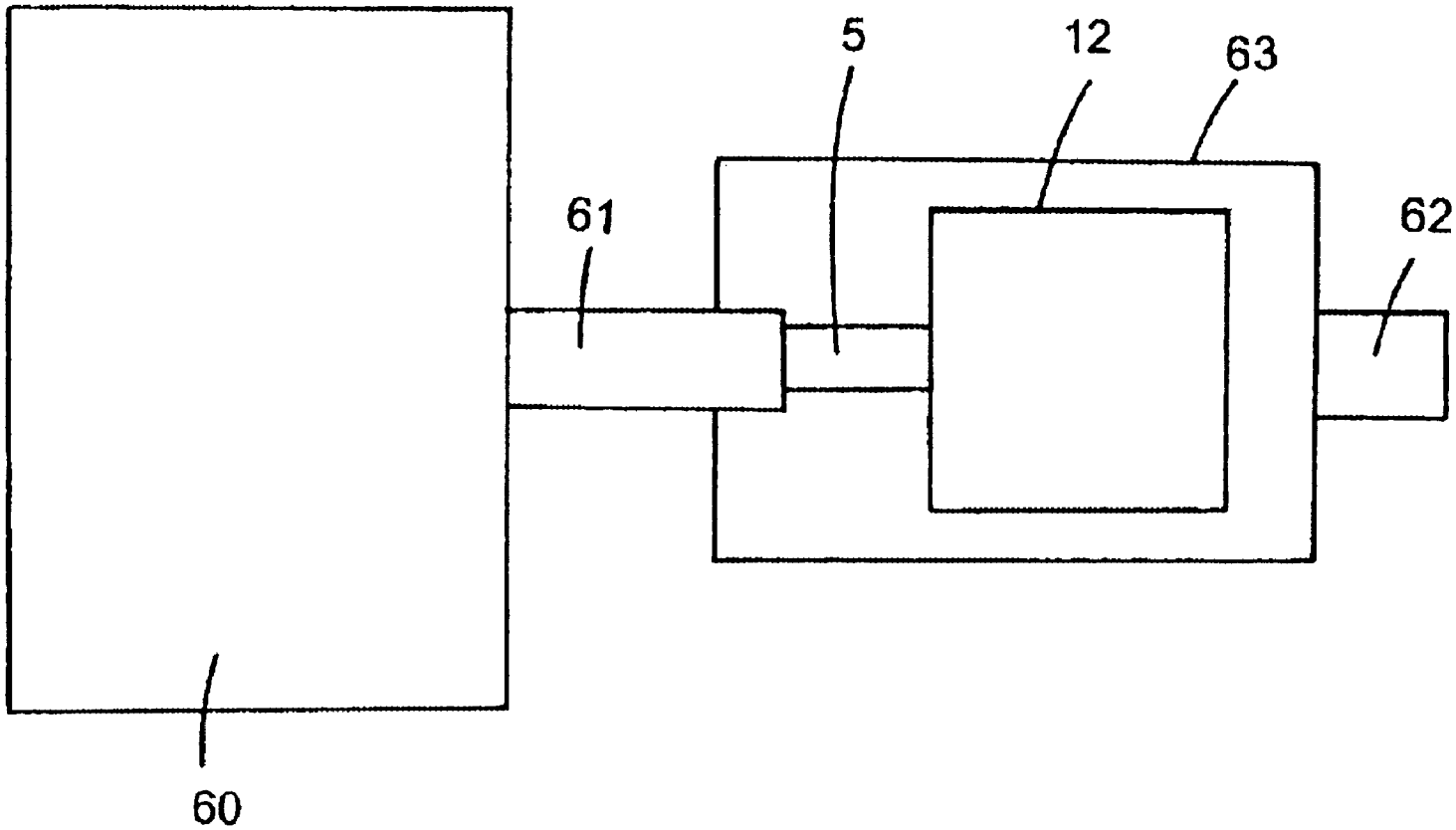
FIG. 6 illustrates the present invention provided with an input shaft to be drivably connected to an engine, an output shaft to be drivingly connected to a load and provided with a roller vane pump, wherein the pump shaft is drivably connected to the engine.

The continuously variable transmission 63 shown in FIG. 6 is provided with an input shaft 61 to be drivably connected to an engine 60, an output shaft 62 to be drivingly connected to a load and provided with a roller vane pump 12 as described here above, wherein the pump shaft 5 is drivably connected to the engine 60.

What is claimed is:

1. A roller vane pump provided with a pump housing accommodating a substantially cylindrical carrier, which is rotatable about a central axis, and a cam ring encompassing the carrier in the radial direction, and with a pump shaft extending co-axial with said central axis through the carrier, wherein there is provided in the pump housing a bearing bush having an essentially cylindrical central bore through which the pump shaft extends, which bearing bush is provided with a lubrication groove on a radially inner surface thereof for allowing fluid to penetrate between the bearing bush and the pump shaft, wherein the lubrication groove starts at a tangential position on the radially inner surface of the bearing bush corresponding to a tangential position of a discharge section of the roller vane pump.

2. Roller vane pump according to claim 1, wherein, when the pump is provided with more than one discharge section, the lubrication groove starts at a tangential position on the radially inner surface of the bearing bush corresponding to a tangential position of a discharge section of the roller vane pump where a prevailing fluid pressure is at a maximum during operation of the pump.

3. Roller vane pump according to claim 1, wherein the bearing bush is made of copper or of a copper alloy.

4. Roller vane pump according to claim 1, wherein the pump housing is predominantly made of aluminium.

5. Roller vane pump according to claim 1, wherein there is provided in the pump housing a further bearing bush, whereby the beating bush and the further bearing bush are each provided on axially opposite sides of the carrier.

6. Roller vane pump according to claim 1, wherein the bearing bush is provided with a hook part formed by a radially outwardly oriented thickening that interacts with the pump housing to prevent axial movement of the bearing bush with respect to the pump housing.

7. Roller vane pump according to claim 1, wherein there is provided a cavity that is in communication with a pump chamber through a gap between the carrier and the pump housing and with a gap between the bearing bush and the pump shaft.

8. A continuously variable transmission provided with an input shaft to be drivably connected to an engine, an output shaft to be drivingly connected to a load and provided with a roller vane pump according to claim 1, wherein the pump shaft is drivably connected to the engine.

9. Roller vane pump according to claim 1, wherein the lubrication groove has a substantially elongated shape having a long axis, whereby the lubrication groove starts at an axial end of the bearing bush closest to the carrier and continues in a direction having at least an axial component.

10. Roller vane pump according to claim 9, wherein the lubrication groove is predominantly located in a region of tangential positions on the radially inner surface of the bearing bush where a contact pressure between the pump shaft and bearing bush is relatively low, at least during operation of the pump.

11. Roller vane pump according to claim 1, wherein the lubrication groove tangentially extends from the said tangential position in a direction of rotation of the pump shaft.

12. Roller vane pump according to claim 11, wherein the bearing bush is provided with a further lubrication groove on its radially inner surface, which further lubrication groove starts at an axial end of the bearing bush closest to the carrier and continues in a direction having an axial component, whereby the further lubrication groove tangentially extends opposite the direction of rotation of the pump shaft.

13. Roller vane pump according to claim 1, wherein the lubrication groove is dimensioned such that it tangentially extends over an angle that approximately corresponds to $\pi$ minus $\frac{1}{2}\pi$ divided by the number of pump units of the pump.

14. Roller vane pump according to claim 13, wherein the bearing bush is provided with a further lubrication groove on its radially inner surface, which further lubrication groove starts at an axial end of the bearing bush closest to the carrier and continues in a direction having an axial component, whereby the further lubrication groove tangentially extends opposite the direction of rotation of the pump shaft.

15. Roller vane pump according to claim 1, wherein the bearing bush is provided with a distribution groove on its radially inner surface, which distribution groove has a substantially elongated shape having a long axis that is substantially axially oriented and that intersects the long axis of the lubrication groove.

16. Roller vane pump according to claim 15, wherein the distribution groove is dimensioned such that there remains an axial distance between the distribution groove and either axial end of the bearing bush of at least ¼ of an axial dimension of the bearing bush.

17. A roller vane pump provided with a pump housing accommodating a substantially cylindrical carrier, which is rotatable about a central axis, and a cam ring encompassing the carrier in the radial direction, and with a pump shaft extending co-axial with said central axis through the carrier, wherein there is provided in the pump housing a bearing bush having an essentially cylindrical central bore through which the pump shaft extends, which bearing bush is provided with a lubrication groove on a radially inner surface thereof for allowing fluid to penetrate between the bearing bush and the pump shaft, wherein the lubrication groove starts at a tangential position on the radially inner surface of the bearing bush corresponding to a tangential position of a discharge section of the roller vane pump and at an axial end of the bearing bush closest to the carrier and ends at some distance from an axial end of the bearing bush opposite the said axial end closest to the carrier.

* * * * *